United States Patent [19]

Howard

[11] Patent Number: 4,928,492

[45] Date of Patent: May 29, 1990

[54] CRYOGENIC PRODUCT TREATING APPARATUS

[76] Inventor: Henry H. Howard, 611 N. Franklin St., Modesto, Calif. 95351

[21] Appl. No.: 281,282

[22] Filed: Dec. 8, 1988

[51] Int. Cl.[5] ..... F25D 13/06

[52] U.S. Cl. ..... 62/63; 62/266; 62/374; 62/380

[58] Field of Search ..... 62/63, 64, 65, 266, 62/374, 380

[56] References Cited

U.S. PATENT DOCUMENTS

| | | | |
|---|---|---|---|
| 3,413,818 | 12/1968 | Pelmulder | 62/380 |
| 3,485,055 | 12/1969 | Webster et al. | 62/63 |
| 3,494,140 | 2/1970 | Harper et al. | 62/65 |
| 3,664,146 | 5/1972 | Butts | 62/63 |
| 3,774,524 | 11/1973 | Howard | 62/64 |
| 3,793,937 | 2/1974 | Lipoma | 62/374 |
| 4,403,479 | 9/1983 | Rasovich | 62/380 |

*Primary Examiner*—Ronald C. Capossela

*Attorney, Agent, or Firm*—Fleit, Jacobson, Cohn, Price, Holman & Stern

[57] ABSTRACT

A closed pressure vessel is provided having a cryogenic liquid bath therein utilizing a bath liquid having a low boiling point temperature. Product treatment ingress and egress structure incorporating vapor lock structure is provided for passing a product to be treated into the interior of the vessel from the exterior thereof and from within the vessel to the exterior thereof and the interior of the vessel includes product support structure operative to support a product to be treated within the cryogenic liquid only as long as it is necessary to lower the outer boundary layer, only, of the product to a temperature below the aforementioned boiling point temperature and which is operable to then remove the product being treated from within the bath and, after a predetermined time interval, and in conjunction with the vapor lock structure, past the treated product to the exterior of the vessel, the aforementioned predetermined time interval being as long as necessary to allow the residual heat in the product inwardly of the outer boundary layer thereof to migrate to the outer boundary layer outer surfaces for the purpose of vaporizing any cryogenic liquid remaining on the external surfaces of the product before the product passes from the interior of the vessel to the exterior thereof. Further, cryogenic liquid condensing structure is disposed within the pressure vessel and operative to condense the cryogenic liquid vaporized from the exterior surfaces of the product treated and direct the condensed liquid back to the cryogenic liquid bath.

15 Claims, 4 Drawing Sheets

18
102
2
62
Vac
P
30
54
76
Vac
P
58
12
78
14

80
82
10
66
68
56
98
Vac
P
70
96
28
84
86
60
Vac
P
48
2
40
52
16

94
102
90

92

CRYOGENIC PRODUCT TREATING APPARATUS

BACKGROUND OF THE INVENTION

1. Field of the Invention

The present invention embodies an apparatus and method for exterior surface cleansing and outer boundary layer cooling a product through the utilization of a liquid coolant bath enclosed within a pressure vessel and wherein the product to be treated is introduced into and withdrawn from the interior of the pressure vessel through vapor lock structure including transfer chambers closable from the ambient atmosphere and the atmosphere within the pressure vessel and which may be vacuumed, selectively, to ambient atmosphere and the atmosphere within the pressure vessel above the liquid coolant level therein. The utilization of closable transfer chambers enables the utilization of a low boiling point coolant liquid with extremely low loss of that coolant liquid.

2. Description of Related Art

My prior U.S. Pat. No. 3,774,524, dated Nov. 27, 1973, discloses a closed pressure vessel into which a product to be treated may be introduced through vapor lock structure and in which the product being treated may be surface cleansed and outer boundary layer cooled. However, the apparatus disclosed in my above noted prior patent relies upon heater structure to cause coolant liquid remaining on the exterior surfaces of the product being treated, after removal of the product from the coolant liquid, to vaporize the coolant liquid on the surface of the product and thereby requires the utilization of higher capacity condensor structure within the pressure vessel to condense the vaporized bath liquid for return to the liquid bath. In addition, the vapor lock structure disclosed in my prior patent is not operative to maintain an appreciable pressure differential between the exterior and interior of the associated pressure vessel.

SUMMARY OF THE INVENTION

The product treating apparatus of the instant invention has been specifically designed for exterior surface cleansing and outer boundary layer cooling a product through the utilization of a cryogenic liquid bath and with minimum loss of the cryogenic liquid.

The apparatus incorporates a combination of novel structural and operational features and further carries out a product treating method which enables production product treatment with minimum loss of cryogenic liquid and liquid vapors.

The main object of this invention is to provide a method and apparatus for production treatment of a product through the usage of a cryogenic liquid and in a manner such that minimum loss of the cryogenic liquid is encountered.

Another object of this invention is to provide a method of treating electronic components such as semiconductor parts to achieve longer shelf life of such parts.

Another object of this invention is to provide a product treating apparatus in accordance with the preceding objects and which may be operated through the utilization of a minimum amount of power input.

A final object of this invention to be specifically enumerated herein is to provide a cryogenic product treating apparatus in accordance with the preceding objects and which will conform to conventional forms of manufacture, be of relatively simple construction and efficient in operation so as to provide a device that will be economically feasible, long lasting and highly efficient in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
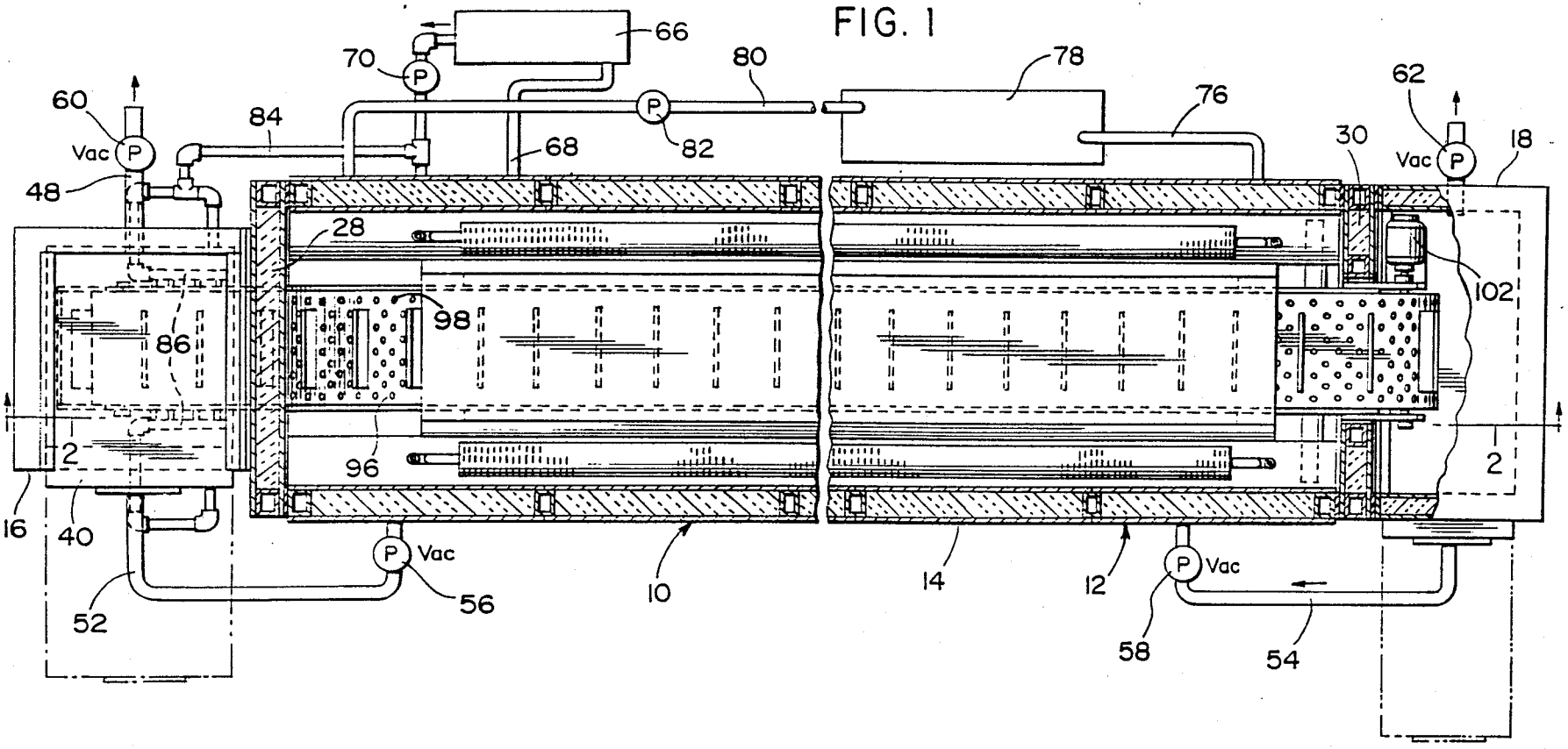
FIG. 1 is a top plan view of the apparatus of the instant invention with parts of the main pressure vessel portion thereof broken away and illustrated in horizontal section.
Figure 6:
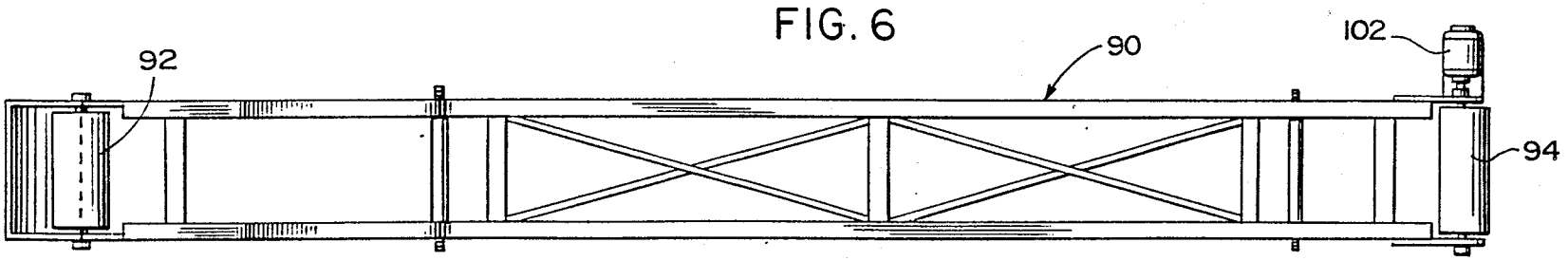
FIG. 6 is a top plan view of the conveyor frame of the apparatus with the conveyor belt and belt guide structure removed.

Referring now more specifically to the drawings, the numeral 10 generally designates the cryogenic product treating apparatus of the instant invention. The apparatus 10 incorporates a pressure vessel referred to in general by the reference numeral 12 including a central main section 14 and opposite end product inlet and product outlet end sections 16 and 18. The pressure vessel incorporates a skeletal frame referred to in general by the reference numeral 20 and inner and outer wall assemblies 22 and 24 supported from the skeletal frame 18 and having a thick layer of heat insulative material 26 interposed between the inner and outer wall assemblies 22 and 24.

The central section 14 is partially closed at its opposite inlet and outlet ends by insulated end walls 28 and 30 having low and high level openings 32 and 34 formed therein with which the sections 16 and 18 are sealingly communicated. The end sections 16 and 18 define transfer chambers 36 and 38 closed to the ambient atmosphere by openable sliding doors 40 and 42 and closed to the interior of the central section 14 by openable sliding doors 44 and 46, the chambers 36 and 38 having first vacuum pipes 48 and 50 opening thereinto through which atmosphere within the chambers 36 and 38 may be vacuumed to the ambient atmosphere. Also, vacuum pipes 52 and 54 open into the chambers 36 and 38 for vacuuming the atmosphere therein into the central section 14, vacuum pumps 56 and 58 being operatively associated with the pipes 52 and 54. Further, similar vacuum pumps 60 and 62 are operatively associated with the pipes 48 and 50.

A cooler 66 is provided and serially connected in a pipe 68 opening outwardly of the central section 14 and also has a pump 70 serially connected therein whereby the cooled liquid bath 72 within the pressure vessel 12 may be pumped therefrom, through the cooler 66 and back into the interior of the center section 14, the cooler 66 being of any suitable type. In addition, the outlet end of the central section 14 includes a drain sump 74 from which the liquid bath 72 may be gravity drained from within the pressure vessel 12 through a drain pipe 76 opening into an insulated storage tank 78 depressed relative to the pressure vessel 12. In addition, a refill pipe 80 opens outwardly of the storage tank 78 and has a pump 82 serially connected therein operative to pump the bath liquid 72 from the storage tank 78 back into the inlet end of the central section 14 of the pressure vessel 12. Still further, a supply pipe 84 has its inlet end opening into the discharge end of pipe 68 and therefore receives cooled liquid 72 from the cooler 66. The supply pipe 84 is connected to manifold pipes 86 mounted within the end section 16 for a purpose to be hereinafter more fully set forth.

Mounted within the pressure vessel 12 is a conveyor frame referred to in general by the reference numeral 90 and the conveyor frame includes end rollers 92 and 94 about which the opposite ends of an endless paddle equipped conveyor belt 96 are trained, the belt 96 having drain openings 98 formed therein. The frame 90 also includes opposite side guide flange structures 100 by which the upper and lower reaches of the belt 96 are guided longitudinally of the frame 90 and the roller 94 is driven by a variable speed motor 102 of any suitable type.

Figure 2:
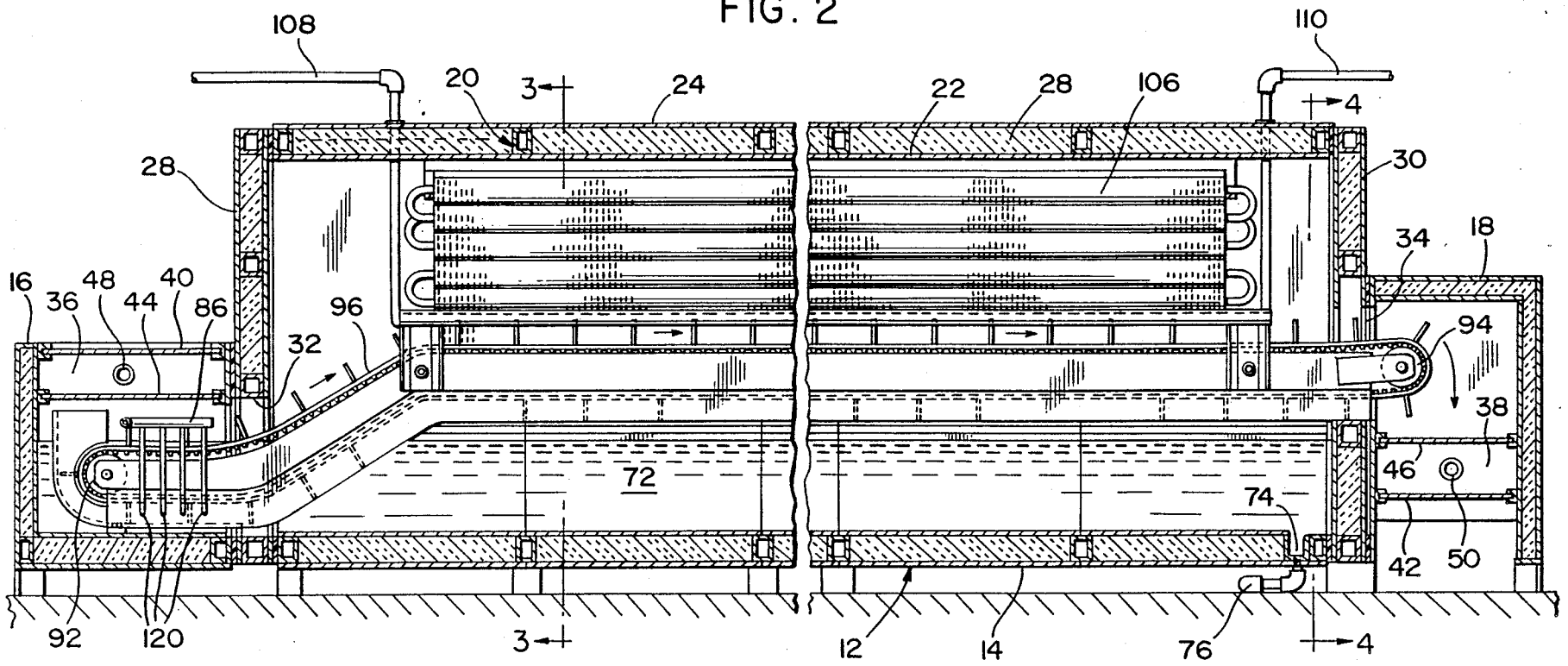
FIG. 2 is a vertical, sectional view taken substantially upon the plane indicated by the section line 2—2 of FIG. 1.
Figure 7:
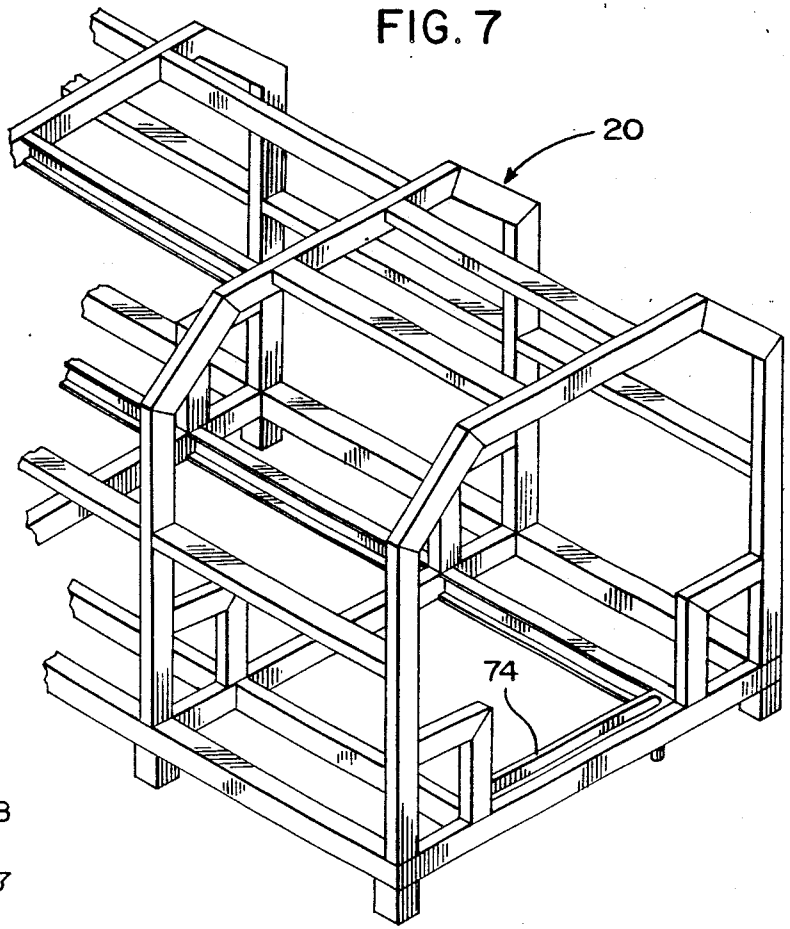
FIG. 7 is a fragementary, perspective view of the inlet end of the main pressure vessel section.
Figure 3:
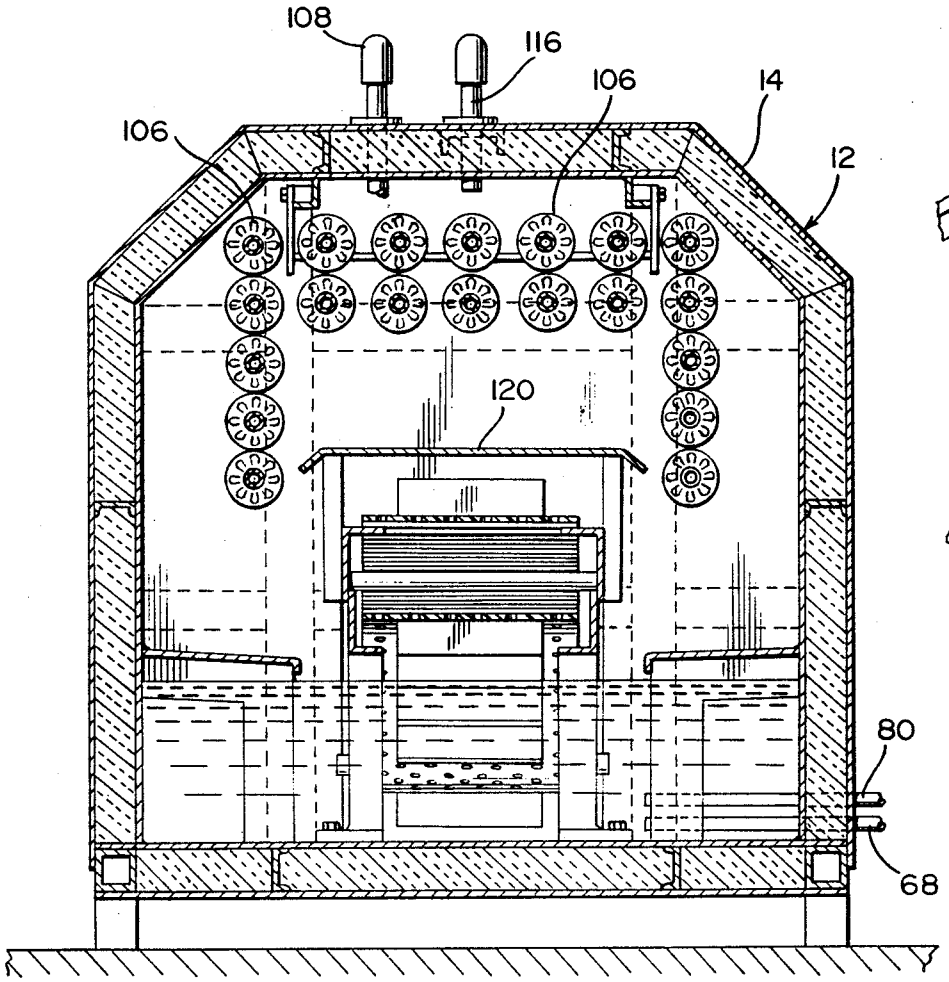
FIG. 3 is an enlarged, transverse, vertical, sectional view taken substantially upon the plane indicated by the section line 3—3 of FIG. 2.
Figure 5:
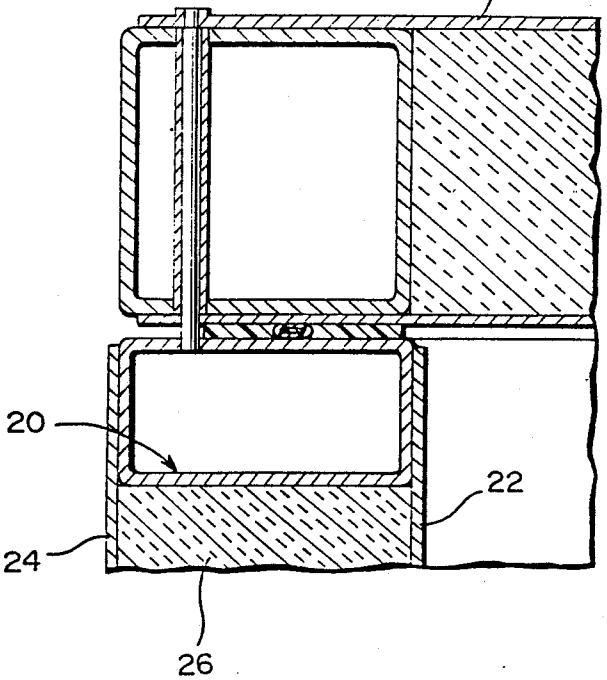
FIG. 5 is an enlarged, fragmentary, horizontal, sectional view taken substantially upon the plane indicated by the section line 5—5 of FIG. 4.
Figure 4:
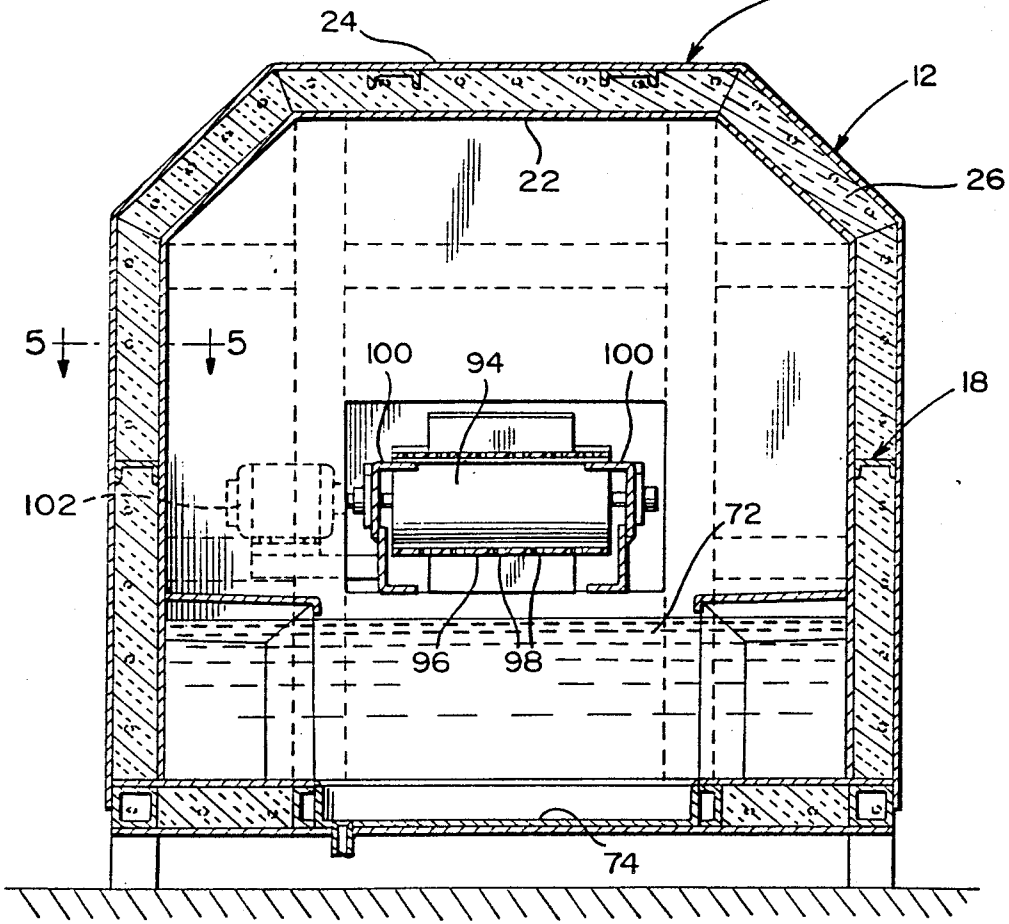
FIG. 4 is an enlarged, transverse, vertical, sectional view taken substantially upon the plane indicated by the section line 4—4 of FIG. 2.

With reference now more specifically to FIG. 3 of the drawings, it may be seen that the upper portion of the interior of the center section 14 of the pressure vessel 12 includes tube condensors 106 through which a chilled liquid coolant of any suitable type is circulated. The coolant liquid is supplied to the tube condensors 106 from an inlet pipe 108 and returned to the supply (not shown) of chilled liquid coolant through an outlet pipe 110, see FIGS. 2 and 3.

The upper portion of the center section 14 of the pressure vessel 12 additionally includes a safety valved vent outlet 116 for relieving excess pressures which might occur within the pressure vessel 12 and the manifold pipes 86 disposed within the end section 16 supply cooled bath liquid 72 from the cooler 66 to individual discharge jets 120 on opposite sides of the lower reach of the belt 96. The discharge jets 120 serve to agitate the bath liquid 72 within the end section 16.

Assuming that electronic components such as, but not limited to, chips and other semi-conductor parts are to be treated, the chips and/or other semi-conductor parts enter the upper portion of the inlet section 16 after the door or panel 40 has been slid to the open position thereof, the product to be treated being placed upon the closed panel or door 44. Then, the panel or door 40 is closed and the interior of the chamber 36 is vacuumed to the ambient air by means of the vacuum pump 60. Thereafter, the panel or door 44 is opened and the product to be treated is allowed to fall down on the belt 96 below the surface of the coolant bath liquid 72. The agitated liquid bath 72 then performs a cleansing action on the external surfaces of the product being treated and the outer boundary layer, only, of the product being treated is appreciably cooled. The speed of movement of the conveyor is such that the product being treated will be elevated above the surface of the bath 72 before further cooling of the product occurs and the product is then conveyed toward the end section 18.

As the product is being conveyed toward the end section 18 the chamber 36 may be vacuumed to the interior of the central section 14 by the vacuum pump 56 and the heat of the product inwardly of the outer boundary layer thereof moves toward and through the outer boundary layer of the product to the outer surface thereof. This causes any liquid bath remaining on the outer surface of the product to be heated above the boiling point temperature of the liquid bath 72 and to be vaporized from the product. The tube condensors 106 then serve to condense the vaporized coolant bath liquid and the bath liquid accumulating on the tube condensors 106 drops therefrom and onto the shield 120 which overlies substantially the entire length of the upper reach of the belt 96. The condensed liquid then drains from the opposite sides of the shield 120 back into the bath liquid 72 in the lower portion of the pressure vessel 12.

By the time the product is conveyed the full length of the upper reach of the belt 96 and into the end section 18, all bath liquid on the exterior surface of the product has been evaporated therefrom and the dry product is deposited upon the panel or door 46. The chamber 36 has been previously vacuumed to the ambient atmosphere and the panel or door 46 is then opened in order to allow the product within the end section 18 to fall down upon the door or panel 42. The door or panel 46 is then closed and the chamber 38 is vacuumed to the interior of the central section 14 through utilization of the vacuum pump 58. Thereafter, the panel or door 42 is opened and the treated product drops from the chamber 38 outwardly of the bottom of the end section 18. Then, the door or panel 42 is closed and the interior of the chamber 38 is vacuumed to ambient air through utilization of the vacuum pump 62.

The bath liquid 72 may comprise any suitable coolant such as "Freon". Further, it is pointed out that the cooling action on electronic components such as chips and other semi-conductor parts tends to increase the shelf life of such components by approximately four. In addition, the apparatus 10 also may be used for further cleansing and partial freezing of food products.

Although other apparatuses and methods may use similar coolants in generally the same manner, particularly the apparatus and method disclosed in my prior mentioned U.S. patent, these previous apparatuses and methods tend to use coolant liquids in ways which result in loss of considerable amounts of coolant liquids, whereas the instant invention realizes little loss of coolant liquid over extended periods of operation and requires the expenditure of considerably less energy inasmuch as the electric resistance heaters disclosed in my above mentioned prior U.S. patent are not required.

With the instant invention, only the outer boundary layer of the product being treated is chilled and the product being chilled is conveyed, after being extracted from the coolant liquid, to the outlet end of the apparatus and discharged therefrom only after a time interval sufficient to enable the remaining heat inward of the outer boundary layer of the product being treated to migrate through the outer boundary layer of the product and to the outer surfaces thereof in a manner such that all coolant liquid remaining on the outer surface of the product being treated is vaporized therefrom before the treated product is received in the chamber 38 and the panel or door 46 is closed. Accordingly, other than the necessary power requirements to maintain the bath liquid 72 at the proper temperature and the power required to drive the conveyor belt 96, the only other power requirements of the apparatus 10 are those required by the tube condensors 106 and the various pumps 56, 58, 60, 62, 70 and 82 as well as any power requirements which may exist for power opening and closing the doors or panels 40, 42, 44 and 46.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A method of exterior surfacing cleansing and outer boundary layer cooling a product, said method including providing a closed vessel having a cooled bath liquid therein and wherein said bath liquid has a boiling point temperature considerably below ambient temperature and the temperature of said bath liquid is below said boiling point temperature, introducing said product into said pressure vessel, from the exterior thereof, through mechanical vapor lock structure and placing said product in said bath liquid with said product at an initial temperature appreciably above said boiling point temperature, allowing said product to remain in said bath liquid only for a time interval sufficient to cause the outer boundary layer, only, of said product to be appreciably cooled below said boiling point temperature, withdrawing said product from said bath liquid and, after a predetermined time, removing said product from said vessel through vapor lock structure, said predetermined time period being only of sufficient duration to allow residual heat in said product inwardly of said outer boundary layer and above the boiling point temperature of said bath liquid to migrate, by conduction, to the outer surfaces of said product for vaporizing any remaining bath liquid on said outer surfaces.

2. The method of claim 1 wherein said vapor lock structure includes chamber structure closable from the ambient atmosphere and the atmosphere within said vessel above said bath liquid, and means operative to pump substantially all atmosphere from said chamber structure, selectively, to the ambient atmosphere and the interior of said vessel above said bath liquid.

3. The method of claim 1 including the step of condensing the bath liquid vapor within said vessel vaporized from the outer surfaces of said product and returning the condensed bath liquid to said bath liquid.

4. The method of claim 1 including the step of causing said liquid bath to be agitated in the area thereof in which said product is initially introduced.

5. The method of claim 4 wherein said vapor lock structure includes chamber structure closable from the ambient atmosphere and the atmosphere within said vessel above said bath liquid, and means operative to pump substantially all atmosphere from said chamber structure, selectively, to the ambient atmosphere and the interior of said vessel above said bath liquid.

6. The method of claim 5 including the step of condensing the bath liquid vapor within said vessel vaporized from the outer surfaces of said product and returning the condensed bath liquid to said bath liquid.

7. The method of claim 1 including the step of causing said bath liquid to circulate through a cooler to maintain said bath liquid below said boiling point temperature.

8. An apparatus for surface cleansing and outer boundary layer cooling a product, said apparatus including a closed vessel having a cooled bath liquid therein and wherein said bath liquid has a boiling point temperature considerably below ambient temperature, cooler means operative associated with said bath liquid for maintaining the temperature of said bath liquid below said boiling point temperature, said vessel including mechanical vapor lock structure equipped product ingress and egress means for receiving a product to be treated in said pressure vessel from the exterior thereof and removal of a treated product from within said pressure vessel to the exterior thereof, said vessel including product support structure therein for supporting a product received in said vessel through the last mentioned means with said product disposed below the level of said liquid bath, said product support structure also including means for elevating said product above the level of said bath liquid after a time interval to cause the outer boundary layer, only, of said product to be cooled below said boiling point temperature, in conjunction with said last mentioned means, to discharge said product from said pressure vessel, after a predetermined time period of sufficient duration to allow residual heat in said product inwardly of said outer boundary layer and above the boiling point temperature of said liquid to migrate to the outer surfaces of said product for vaporizing any remaining bath liquid on said outer surfaces.

9. The apparatus of claim 8 wherein said last mentioned means includes chamber means closable from ambient atmosphere and the atmosphere within said vessel above said bath liquid and means operative to pump substantially all atmosphere from said chamber means, selectively, to the ambient atmosphere and the interior of said vessel above said bath liquid.

10. The apparatus of claim 9 wherein said vessel includes interior vapor condensing means operative to condense the bath liquid vaporized from the outer surfaces of said product and to return the condensed bath liquid to said liquid bath.

11. The apparatus of claim 8 wherein said apparatus includes means for agitating said liquid bath in the area thereof in which said product is supported by said product support structure.

12. The apparatus of claim 11 wherein said vessel includes interior vapor condensing means operative to condense the bath liquid vaporized from the outer surfaces of said product and to return the condensed bath liquid to said liquid bath.

13. The apparatus of claim 12 wherein said last mentioned means includes chamber means closable from ambient atmosphere and the atmosphere within said vessel above said bath liquid and means operative to pump substantially all atmosphere from said chamber means, selectively, to the ambient atmosphere and the interior of said vessel above said bath liquid.

14. The apparatus of claim 8 wherein said vapor lock structure equipped product ingress and egress means includes a separate product ingress structure and a separate product egress structure between which said product support structure is operative to convey the product introduced into said pressure vessel.

15. The apparatus of claim 14 wherein each of said product ingress and product egress means includes a transfer chamber closable from the ambient atmosphere and the atmosphere within said vessel above said bath and each of said chambers includes vacuum pump means operatively associated therewith for pumping substantially all of the atmosphere, selectively, therefrom to the ambient atmosphere and the interior of said vessel above said liquid bath.

* * * * *